United States Patent [19]

Widemann et al.

[11] 4,092,622

[45] May 30, 1978

[54] COIL BODY

[75] Inventors: Rudolf Widemann, Neubiberg; Roland Ehrgott, Munich, both of Germany

[73] Assignee: Siemens Aktiengesellschaft, Berlin & Munich, Germany

[21] Appl. No.: 785,733

[22] Filed: Apr. 8, 1977

[30] Foreign Application Priority Data

Apr. 21, 1976 Germany ..... 2617466

[51] Int. Cl.[2] ..... H01F 15/10

[52] U.S. Cl. ..... 336/192; 339/217 S

[58] Field of Search ..... 336/192, 198, 208; 339/217 S; 310/71

[56] References Cited

U.S. PATENT DOCUMENTS

| | | | |
|---|---|---|---|
| 1,747,896 | 2/1930 | Gates | 339/217 S |
| 2,497,484 | 2/1950 | Wood | 339/217 S |
| 3,076,165 | 1/1963 | Weyrich | 336/192 X |
| 3,189,857 | 6/1965 | Jones | 336/192 X |
| 3,270,311 | 8/1966 | Deer et al. | 339/217 S X |
| 3,281,744 | 10/1966 | Melanson | 336/208 X |
| 3,371,302 | 2/1968 | Mas | 336/192 X |
| 3,500,274 | 3/1970 | Matsura et al. | 336/192 X |
| 3,566,322 | 2/1971 | Horbach | 336/192 |

FOREIGN PATENT DOCUMENTS

| | | | |
|---|---|---|---|
| 1,100,973 | 9/1955 | France | 336/192 |
| 2,315,484 | 10/1974 | Germany | 339/217 S |
| 1,170,189 | 11/1969 | United Kingdom | 339/217 R |
| 348,405 | 5/1931 | United Kingdom | 336/192 |

*Primary Examiner*—Thomas J. Kozma

*Attorney, Agent, or Firm*—Hill, Gross, Simpson, Van Santen, Steadman, Chiara & Simpson

[57] ABSTRACT

An electronic coil assembly having a coil body with attached soldering elements having projecting tangs extending at right angles from one another forming, respectively, pins for attachment of the coil onto printed circuit boards and soldering lugs for attachment of the ends of the coil wire, the elements being formed with integral spring means and being snapped into place in openings through flanges of the coil body.

3 Claims, 5 Drawing Figures

COIL BODY

BACKGROUND OF THE INVENTION

1. Field of the Invention

This invention relates to electronic coils, and more particularly to a coil body equipped with snap-in soldering elements.

2. Description of the Prior Art

Electronic coils consisting of a coil body wrapped with a wire coil have previously been provided with pin projections for attachment to printed circuit boards, the pin projections being adapted to have the ends of the coil wire soldered thereto at some point on the projection forming member.

In order to approach an optimum exploitation of space, printed circuits utilize an extremely compact arrangement of the components carried thereon. This requires that the components be positioned in relation to one another in a manner which reduces the mutual magnetic influence thereof. This can be achieved by vertical or parallel alignment of the magnetic axis of each of the electronic coils, chokes, transformers, etc. in relation to each other and to the circuit board.

In the construction of coil bodies for use in such printed circuits, the circuit board contacting projecting tangs which form the board piercing pins must be securely attached to the coil body, which may be a molded piece. Also, it is important that the pins be in electrically conductive communication with the tangs which forms a soldering lug for receipt of the coil wire end. While this is normally accomplished by making the soldering lug and pin as different portions of the same metal piece, attachment to the coil body may be made difficult due to the fact that the soldering lug must be accessible and must therefore project from the body at a side other than the point of projection of the pin. This can complicate the attachment of the soldering element composed of the soldering lug and the pin, to the coil body.

Further, since the same coil body may be used variously in a horizontal or a vertical orientation, it would be advantageous to construct the soldering elements and the method of attaching them to the coil body in such a manner as to allow both easy assembly and assembly with the pins projecting for mounting to the circuit board in either the horizontal or vertical position as desired.

SUMMARY OF THE INVENTION

It is therefore a primary objective of this invention to provide a coil body for the type of electronic components previously described which is of such a construction that the soldering elements can be attached in either the vertical or horizontal direction and where the soldering elements are so designed and constructed as to be easily attachable without the necessity of complex soldering element attachment or construction equipment.

Our invention provides such a device. The coil body is equipped with a flange for the attachment of the soldering elements. The flange is provided with insertion slots having a rectangular cross section through which the tangs of the soldering element can project. Additionally, the element, which is formed with projecting tangs extending at right angles to one another, is formed with a spring means on at least one of the projecting tangs which, when the soldering element is in its full-slot inserted position, will engage against a surface of the coil body flange in a manner to prevent dislodgment of the soldering element.

In one embodiment illustrated, the spring element is shown as a spring arm member extending parallel to the projecting tang and equipped with an abutment ledge defining end portion, which, when the associated tang is received through the slot opening, will snap into opposition engagement with an outside face of the coil body flange preventing withdrawal of the associated tang through the slot.

In a second embodiment illustrated, at least one of the tangs has a spring ear projection struck from intermediate portions of the tang extending in a direction transverse to the longitudinal direction of the tang and received in a closed end recess or groove in a side wall of the slot. When the associated tang is inserted through the slot, the spring projection will snap into the groove preventing withdrawal of the tang by engagement between an end of the spring projection and an end wall of the groove.

The soldering elements described herein can be inserted into the slot openings in the coil body flanges without the use of any special tools. The proper positioning of the tangs will be assured by means of the spring elements, i.e., the spring ear projections or the spring legs, which will safeguard against any dislodgement of the soldering elements from their assembled position. The use of any additional fastening means such as adhesives or subsequent processing of the coil body are not required to insure proper locking of the soldering elements in the coil body flanges. Inasmuch as movement of the soldering element in the one direction will be prevented by abutment of a face of the spring element with a wall face of the coil body flange while movement of the soldering element in other directions will be prevented by abutment of side edge surfaces of the soldering element with walls of the insertion slot, the soldering element will be firmly held in the coil body flange.

It is therefore an object of this invention to provide an improved coil body with attached soldering elements.

It is a further object of the invention to provide a coil body having end flanges with snap-in soldering elements having circuit board connection pins projecting at a right angle to soldering lugs with the pins projecting on one side of the flange and the soldering lugs projecting on another side the flange, the flange being equipped with an insertion slot for receipt of these soldering elements and the soldering elements being equipped with spring members which interlock with portions of the flange body upon insertion of a soldering element into an insertion slot, the interlock preventing withdrawal of the soldering element.

It is yet another and more specific object of this invention to provide a coil body having flanges provided with insertion slots for receipt of right-angled soldering elements, the soldering elements having two projecting tangs which project at a right angle to one another, one of which forms a circuit board attachment pin and the other of which forms a soldering lug, the soldering element being insertable into the insertion slot with either of the projecting tangs projecting from a first face of the flange with the other tang projecting from a second face of the flange, the soldering elements being equipped with spring means which, upon insertion into the insertion slot interlocks with surfaces of the coil body preventing withdrawal of the soldering element from the insertion slot.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
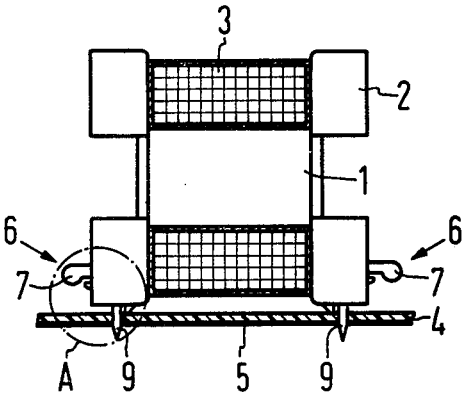
FIG. 1 is a diagrammatic elevational view of an electronic coil attached to a circuit board with the longitudinal central axis of the coil parallel to the circuit board.

As illustrated in FIG. 1, coil body 1 is provided with a central section around which a winding 3 is positioned. The central section is bounded on either longitudinal end by flanges 2. Each of the end flanges is provided with soldering elements 6. The soldering elements 6 include projecting tangs which extend at right angles to one another from a common juncture, one of which provides a soldering lug 7 and the other of which provides a connection pin 9. In the embodiment illustrated in FIGS. 1 and 2, the soldering elements are attached to the flanges such that the pins 9 extend at a right angle to the longitudinal and magnetic axis of the coil. The pins 9 are attached to the printed circuit board 4 by means such as soldering as indicated at 12, the circuit board being equipped with metallic conductor paths 5.

Figure 2:
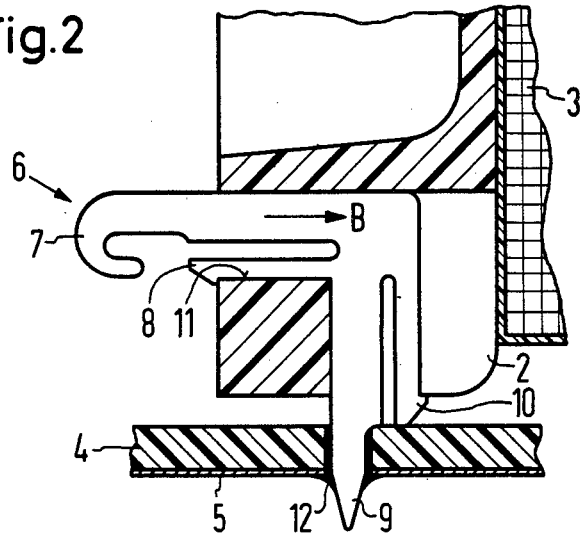
FIG. 2 is a fragmentary, enlarged sectional view of the area "A" of FIG. 1.

The flanges 2 have insertion slots 11 which are rectangular in cross section and which may have a substantially right angle configuration portion as illustrated in FIG. 2 providing a rectangular cross section solid coil body portion at the outer corner of the flange as illustrated by the cross section in the lower left-hand portion of the flange in FIG. 2. The slot 11 is open to an inside face of the flange in the area which will be partially filled with winding 3. The rectangular cross section of the slot provides plainer faces defining the sides of the slot with a top edge of the slot, as shown in FIG. 2, being provided by an interior surface of the coil body and a bottom edge (and one side edge of the slot right angle portion) being provided by surfaces of the rectangular connecting portion as shown in the lower left hand portion of FIG. 2. The soldering elements 6 are inserted into the slot from the interior end of the slot on the right hand side as illustrated in FIG. 2.

Each of the projecting tangs of the soldering element are provided with projecting spring legs 8 and 10 which extend from the juncture portion of the tangs parallel to each of the tangs and terminating short of the tang ends. Each of the spring legs is provided with an outwardly extending projection adjacent its free end which forms an abutment surface. Depending upon whether the tang 7 or the tang 9 is inserted through the slot from the right to the left as illustrated in FIG. 2, either the projection on the spring leg 8 or the projection on the spring leg 10 will, upon complete insertion, snap over the outside face of the flange with the abutment engaging the flange face preventing withdrawal of the soldering element from the slot. In the embodiment illustrated in FIG. 2, the soldering lug 7 has been inserted through the slot and the associated spring leg 8 extends slightly beyond the slot to the exterior of the flange to the point where its projection has snapped down over the outside end face of the flange preventing withdrawal of the soldering element in the direction indicated by the arrow "B". Movement of the soldering element in other directions is prevented because of abutment between side and edge faces of the soldering element with opposed surfaces of the coil body flange defining the slot.

Due to the right angle construction of the soldering element and the provision of spring legs on each of the projecting tangs, either of the tangs can be inserted into the slot to project from the longitudinal end face of the flange. Thus, as shown in FIG. 3, the soldering elements 6 can be inserted into the openings 11 in such a manner that the magnetic axis of the assembled coil will be positioned at a right angle to the circuit board with the pins 9 projecting from the longitudinal end face of the flange.

Figure 3:
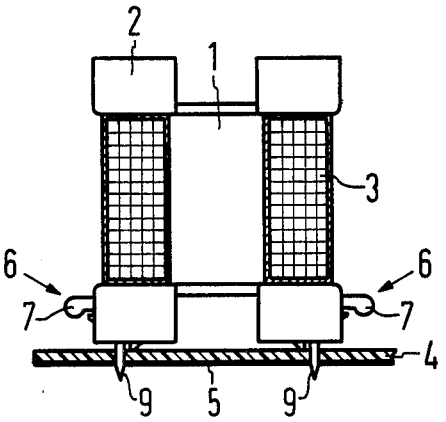
FIG. 3 is a view similar to FIG. 1 illustrating a vertical alignment of the coil to the circuit board.
Figure 4:
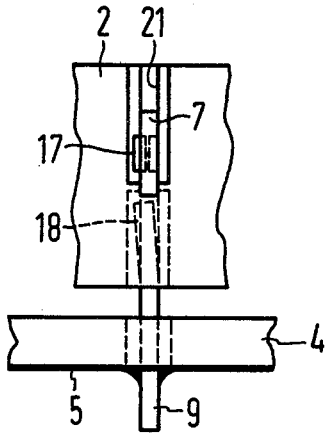
FIG. 4 is a fragmentary side view of a modified form of the invention showing a portion of the coil body and the circuit board.
Figure 5:
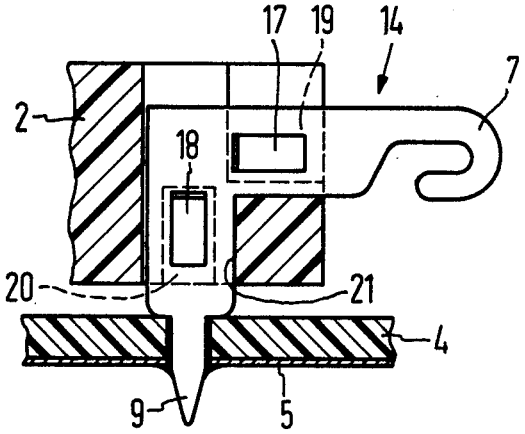
FIG. 5 is a fragmentary sectional view of the embodiment of FIG. 4 taken vertically through FIG. 4.

FIGS. 4 and 5 illustrate a modification of the soldering elements of FIGS. 1 through 3 where the spring element is formed by a spring projection in the manner of an ear struck from the body of the tang intermediate its ends. Thus, the soldering element 14 as shown in FIGS. 4 and 5, is provided with projecting struck spring ears 17 and 18 which have portions projecting transversely to the direction of the projection of the tang from the junction of the tangs of each spring element. When the soldering tang is inserted into the opening 21, which is similar to the opening 11 in the coil body flange, the ears will be received in groove recesses 19 and 20 which widen the insertion slot locally. The recesses 19 and 20 are formed in side walls of the insertion slot and the recess 20 is dimensioned such that when the associated tang is fully positioned in the insertion slot, the ear 19 will snap into the recess adjacent a blind end of the recess as illustrated in FIG. 5. This will prevent vertical withdrawal of the pin 9 in FIG. 5 by abutment of the end face of the ear 18 with the blind end face of the recess 20.

Both the embodiment illustrated in FIGS. 1 through 3 and the embodiment illustrated in FIGS. 4 and 5 can be simply and economically produced with the soldering elements being punched from sheet metal and the coil bodies constructed of case or molded synthetic materials such as plastics. Since the soldering elements can be inserted without the requirement of any complex tools and, due to their abutting spring will be securely attached to the flanges, assembly expense is minimized.

It can therefore be seen from the above that our invention provides a coil body equipped with flanges having insertion slots receiving soldering elements, the soldering elements being provided with spring members which, when the soldering element is fully inserted in the insertion slot, will engage opposed face portions of the coil body preventing withdrawal of the soldering element from the insertion slot.

Although the teachings of our invention have herein been discussed with reference to specific theories and embodiments, it is to be understood that these are by way of illustration only and that others may wish to utilize our invention on different designs or applications.

What we claim is:

1. An electronic coil for use in printed circuits having a coil body provided with longitudinal end flanges and an intermediate coil area, said flanges having longitudinal outer peripheral corners, a soldering element insertion slot through at least one flange adjacent the corner thereof, the slot being substantially right angled and open to adjacent end face and side face of the flange, the flange having a coil area inside face, the slot open to the inside face whereby a soldering element can be inserted into the slot from the inside face, the slot having a rectangular cross section, a soldering element received in the slot, the soldering element having two free ended tangs projecting at right angles from one another with one of the ends providing an attachment pin for attachment to the printed circuit and the other of the ends providing a soldering lug for attachment to an end of a coil wire wrapped on said coil body within the coil area, each of the tangs being substantially rectangular in cross section having flat side faces being dimensioned to be received within the slot with the side faces in opposition to side walls of the slot restricting rotation of the tang within the slot, each of the tangs having an integral spring member associated therewith, the spring member being compressible during insertion of the soldering element into the slot, the spring member having an abutment face thereon, the slot having an abutment face associated therewith, the spring member abutment face lying in opposition to the slot abutment face when the soldering element is fully seated in the slot with one of the tangs projecting longitudinally of the flange, the opposition of the spring member abutment face and the slot abutment face locking the soldering element in the slot, the slot and each of the tangs being dimensioned with respect to one another such that either tang is insertable into the slot projecting longitudinally of the coil body whereby the soldering element can be selectively inserted into the slot with a selected one of the attachment pin ended tang and soldering lug ended tang projecting longitudinally of the coil body with the other one of said tangs projecting transversely of the longitudinal direction of the coil body, the longitudinally projecting tang associated spring member snapping into spring member abutting face opposition to the slot abutment face upon full insertion of the longitudinally projecting tang into a longitudinally extending portion of the slot.

2. The device of claim 1 wherein the soldering element comprises a substantially right angle shape member having two tangs extending away from a common juncture at right angles thereof, each of the tangs having a width and a longitudinal length, each tang terminating in a free end forming one of a pin and a soldering lug, each of the tangs being provided with a struck out spring ear intermediate the juncture and the free end of the tang, the insertion slot having a slot dimension increasing groove therein which terminates within the length of the slot providing a wall extending substantially normal to a longitudinal extent of the slot forming the slot abutment face, the ear having an end face forming the spring abutment face.

3. The device of claim 1 wherein the spring element comprises a spring leg associated with each of the tangs, the spring legs projecting outwardly from an area of juncture of the two tangs with a spring leg extending substantially parallel to each of the tangs, the spring leg terminating in an outturned projection, the outturned projection forming the spring abutment face, an outside face of the flange adjacent the slot forming the slot abutment face.

* * * * *